US005885088A

United States Patent [19]

Brennan et al.

[11] Patent Number: 5,885,088

[45] Date of Patent: Mar. 23, 1999

[54] ELECTRICAL CONNECTOR ASSEMBLY WITH POLARIZATION MEANS

[75] Inventors: Denise Brennan, Ballylehane Wolfhill Laois; Donagh O'Sullivan; Matthew Wilhite, both of Limerick, all of Ireland

[73] Assignee: Molex Incorporated, Lisle, Ill.

[21] Appl. No.: 892,413

[22] Filed: Jul. 14, 1997

[51] Int. Cl.[6] ..... H01R 13/645

[52] U.S. Cl. ..... 439/680; 439/378

[58] Field of Search ..... 439/680, 681, 439/378, 677

[56] References Cited

U.S. PATENT DOCUMENTS

| | | | |
|---|---|---|---|
| 4,790,763 | 12/1988 | Weber et al. | 439/65 |
| 4,850,902 | 7/1989 | Reed | 439/676 |
| 4,889,502 | 12/1989 | Althouse et al. | 439/607 |
| 4,929,184 | 5/1990 | Emadi et al. | 439/681 |
| 4,934,950 | 6/1990 | Green et al. | 439/681 |
| 5,219,301 | 6/1993 | Frantz | 439/680 |
| 5,244,412 | 9/1993 | Hatch et al. | 439/567 |
| 5,257,947 | 11/1993 | Scheer et al. | 439/567 |
| 5,454,734 | 10/1995 | Eggert et al. | 439/578 |
| 5,466,171 | 11/1995 | Bixler et al. | 439/680 |

FOREIGN PATENT DOCUMENTS

| | | | |
|---|---|---|---|
| 3738545 | 5/1989 | Germany | H01R 9/09 |
| 4034690 | 11/1991 | Germany | H05K 3/32 |

*Primary Examiner*—Hien Vu
*Attorney, Agent, or Firm*—Stephen Z. Weiss

[57] ABSTRACT

An electrical connector assembly includes a first connector having a dielectric housing mounting a plurality of terminals. The first connector has a conventional DC jack socket with a central contact pin adapted for receiving a conventional DC jack plug. A second connector mates with the first connector and includes a dielectric housing mounting a plurality of terminals for electrical connection to the terminals of the first connector. The second connector has a locating peg insertable into the DC jack socket of the first connector. The locating peg is generally hollow to accommodate the central contact pin of the DC jack socket.

6 Claims, 4 Drawing Sheets

ELECTRICAL CONNECTOR ASSEMBLY WITH POLARIZATION MEANS

FIELD OF THE INVENTION

This invention generally relates to the art of electrical connectors and, particularly, to a polarization system between a pair of mating electrical connectors.

BACKGROUND OF THE INVENTION

Very generally, electrical connector assemblies are used to interconnect lines or devices which carry electrical power, electrical signals, electrical data or other electrical transmissions. A typical electrical connector assembly includes a pair of individual electrical connectors which are mateable with each other. Each connector typically includes a dielectric housing which mounts a plurality of terminals for making electrical connection with the terminals of the other or mating connector.

Most often, a pair of mateable electrical connectors must be interconnected or mated in a particular orientation so that the respective terminals of the connectors make proper electrical connections. Therefore, a wide range of orienting or "polarizing" means are provided on the connectors to ensure that they are mated in proper orientation. Typically, these polarizing means are extra components or portions of the connector or the connector housing and, consequently, they must be taken into consideration when designing and manufacturing the connectors, and they usually take up space or valuable "real estate" on the connectors. This is a problem when space is of a premium, particularly in the ever-increasing miniaturization and increasing density of electronic transmission systems.

For instance, in mobile telephone systems, a portable handset is used and moved from one location to another. The handset may be mounted into a cradle in an automobile or other vehicle, often by a "blind mating" procedure. When not in the vehicle cradle the handset usually can be charged from sources, such as household or office electrical current or from vehicle current through a cigarette lighter receptacle. The handset, therefore, usually includes a conventional DC jack socket for receiving a conventional DC jack plug from an adapter which is plugged into the household, office or vehicle current.

It can be seen from the above, that the handset of a mobile telephone system has an electrical connector which is mateable within a cradle in a vehicle and which includes a conventional DC jack socket for use when the handset is outside the cradle. The handset connector preferably has some sort of polarizing means to ensure proper orientation of its connector end. Due to the ever-increasing desire for miniaturizing mobile telephone handsets, such polarizing means can take up valuable space in the overall design. The present invention is directed to solving these problems by providing a unique polarization system which utilizes the conventional DC jack socket which typically is used with the handset unit and which helps in locating the mating parts prior to engagement of the connectors.

SUMMARY OF THE INVENTION

An object, therefore, of the invention is to provide a new and improved polarization system for an electrical connector assembly which also helps in the blind mating of the connectors.

In the exemplary embodiment of the invention, the electrical connector assembly includes a first connector having an elongated dielectric housing mounting a generally centrally located array of terminals. A conventional DC jack socket is provided nearer one edge of the elongated housing outside one end of the array of terminals and adapted for receiving a conventional DC jack plug. The DC jack socket has a central contact pin. A polygonal locating socket is provided nearer an opposite edge of the elongated housing outside an opposite end of the array of terminals.

The connector assembly includes a second connector for mating with the first connector and having an elongated dielectric housing mounting a generally centrally located array of terminals for electrical connection to the terminals of the first connector. The second connector has a locating peg nearer one edge of the elongated housing outside one end of the array of terminals and adapted for insertion into the DC jack socket of the first connector. The locating peg is generally hollow to accommodate the central contact pin of the DC jack socket. A polygonal locating post is provided nearer an opposite edge of the elongated housing outside an opposite end of the array of terminals and adapted for insertion into the polygonal locating socket of the first connector.

Therefore, the first connector can be mated with the second connector only when the hollow locating peg of the second connector is aligned with the DC jack socket of the first connector and the polygonal locating post of the second connector is aligned with the polygonal locating socket of the first connector.

As disclosed herein, the locating peg of the second connector is generally C-shaped in cross-section. The polygonal locating socket and the polygonal locating post are generally rectangularly shaped in cross-section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
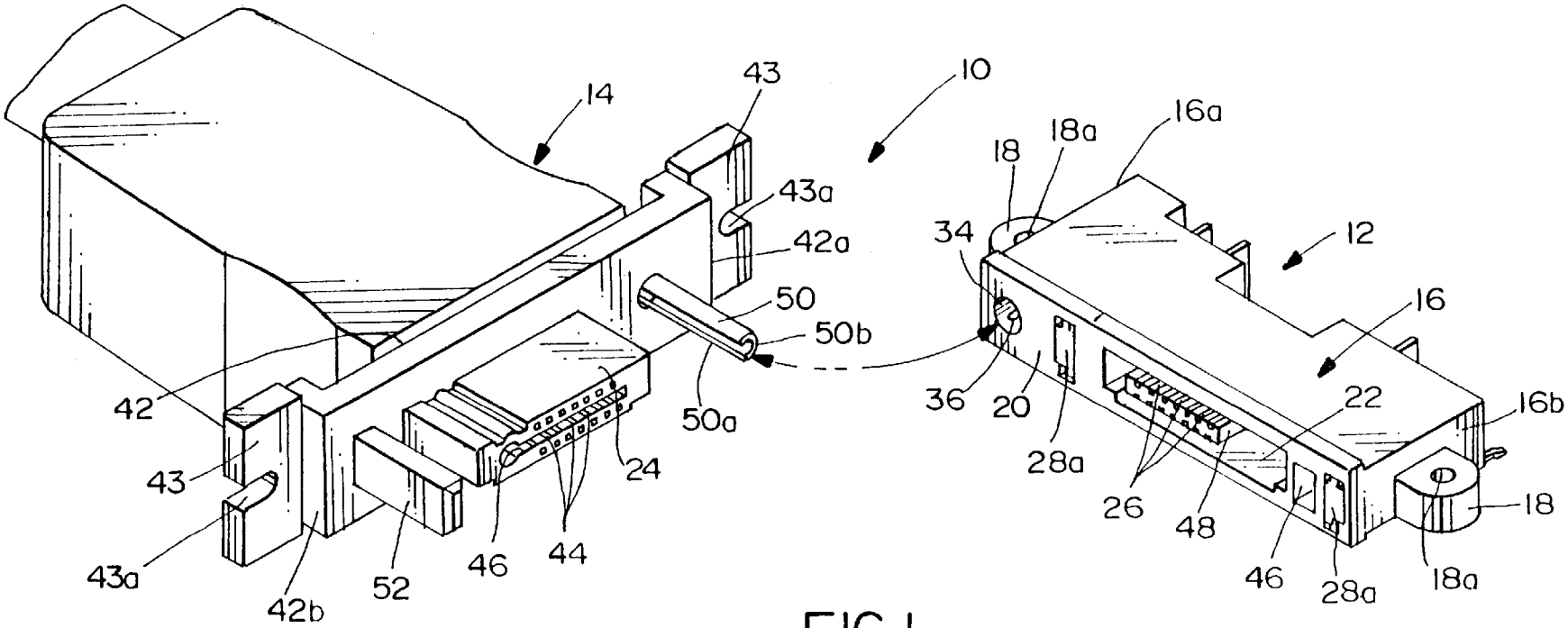
FIG. 1 is a perspective view of an electrical connector assembly embodying the concepts of the invention.

Referring to the drawings in greater detail, the invention is embodied in an electrical connector assembly, generally designated 10, which includes a first or receptacle connector, generally designated 12, and a second or plug connector, generally designated 14. In but one application of the invention, receptacle connector 12 is of a type which can be used in the handset unit of a mobile telephone system. Plug connector 14 is of a type which can be used in the cradle assembly of an automobile or other vehicle. Therefore, except for the novel polarization and blind mating means of the invention, the various terminal arrays of the connectors are generally typical for mobile telephone systems, but the invention is not limited to the specific terminal arrays or application disclosed.

First or receptacle connector 12 is shown in FIGS. 1–6. Second or plug connector 14 is shown in FIGS. 1 and 7–9.

Specifically, referring to FIGS. 1–6, first or receptacle connector 12, which is part of the handset unit, includes an elongated dielectric housing, generally designated 16, which is unitarily molded of dielectric material such as plastic or the like. A pair of integral mounting ears 18 project outwardly from opposite ends of the dielectric housing and include apertures 18*a* for receiving appropriate fastening means to mount the connector, such as in the base of a mobile telephone handset. The housing defines a mating face 20 which is exposed at the base of the handset. The housing defines a receptacle 22 for receiving a plug portion 24 (FIG. 1) of plug connector 14.

Figure 2:
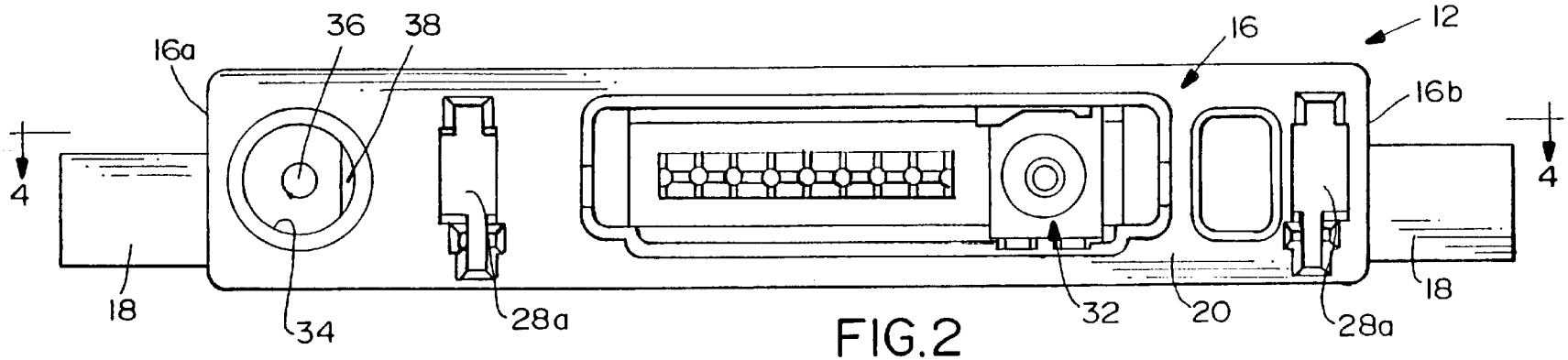
FIG. 2 is a front elevational view of the first or receptacle connector.
Figure 3:
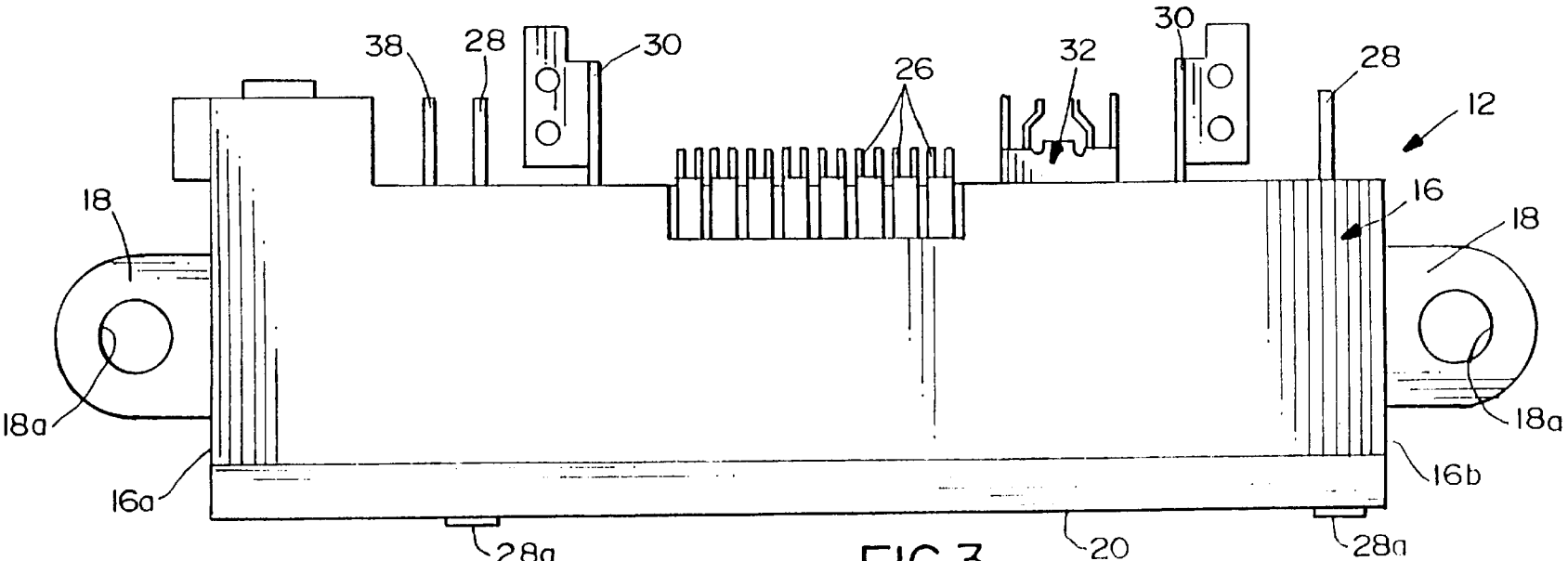
FIG. 3 is a top plan view of the receptacle connector.
Figure 4:
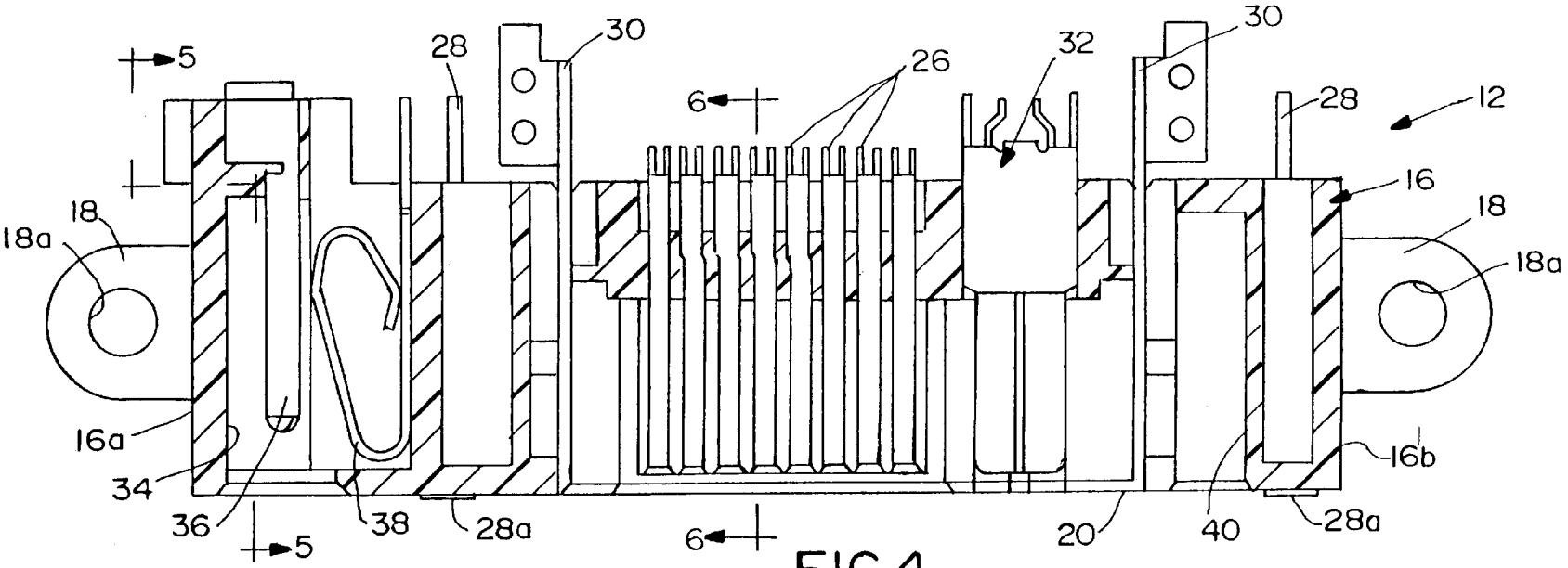
FIG. 4 is a horizontal section taken generally along line 4—4 of FIG. 2.

Receptacle connector 12 of electrical connector assembly 10 includes a fairly typical array of terminals. Specifically, as best seen in FIGS. 1, 2 and 4, receptacle connector 12 includes a generally centrally located array of signal terminals 26 and a pair of charging terminals 28 having charger pads 28*a* exposed at mating face 20 of housing 16. The connector may include a pair of latch shoulders 30 and a coaxial connector, generally designated 32. Finally, housing 16 of first or receptacle connector 12 includes a conventional DC jack socket 34 nearer one edge 16*a* of the elongated housing outside one end of the array of signal terminals 26. As is known, the DC jack socket includes a central contact pin 36. An outside spring contact 38 is located to one side of central pin contact 36. Finally, a polygonal locating socket 40, which is rectangular in this embodiment, is provided in housing 16 nearer an opposite edge 16*b* outside an opposite end of the centrally located array of terminals 26.

Figure 7:
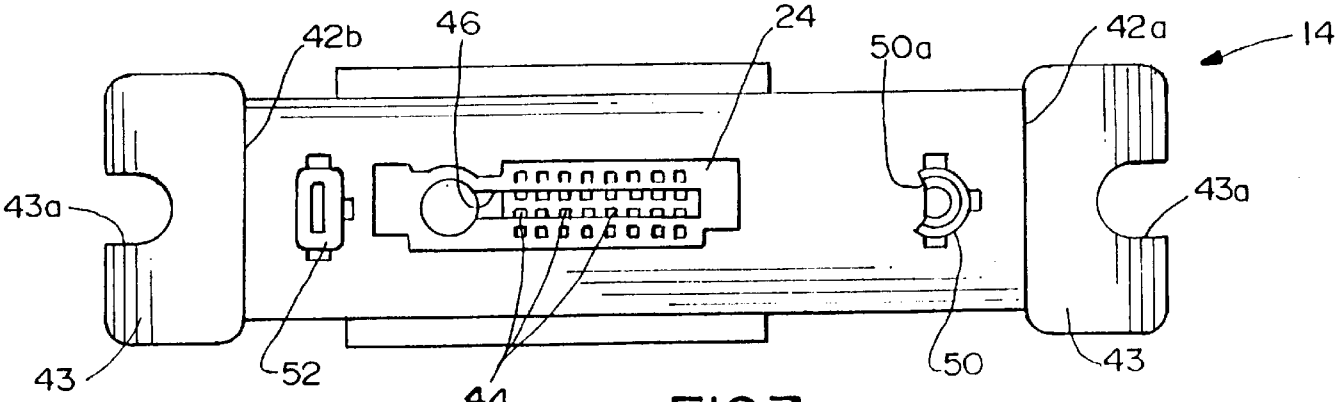
FIG. 7 is a front elevational view of the second or plug connector.
Figure 5:
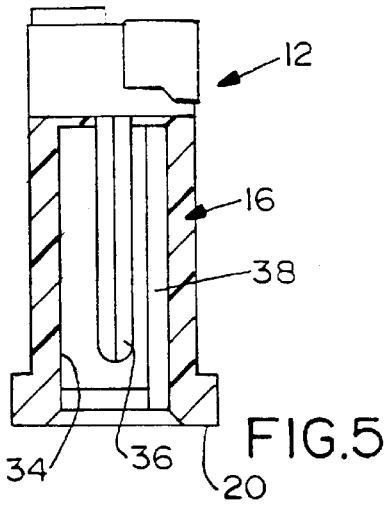
FIG. 5 is a vertical section taken generally along line 5—5 of FIG. 4.
Figure 6:
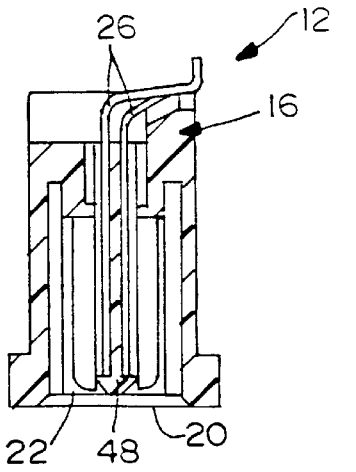
FIG. 6 is a vertical section taken generally along line 6—6 of FIG. 4.
Figure 9:
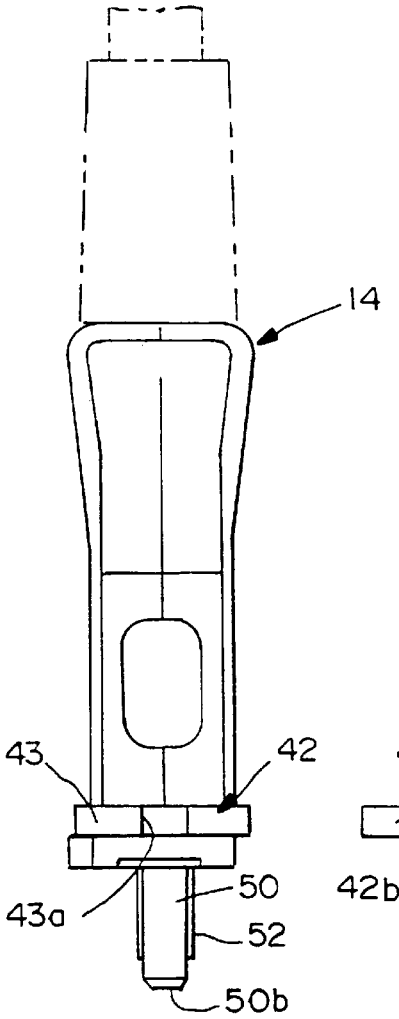
FIG. 9 is an end elevational view of the plug connector.
Figure 8:
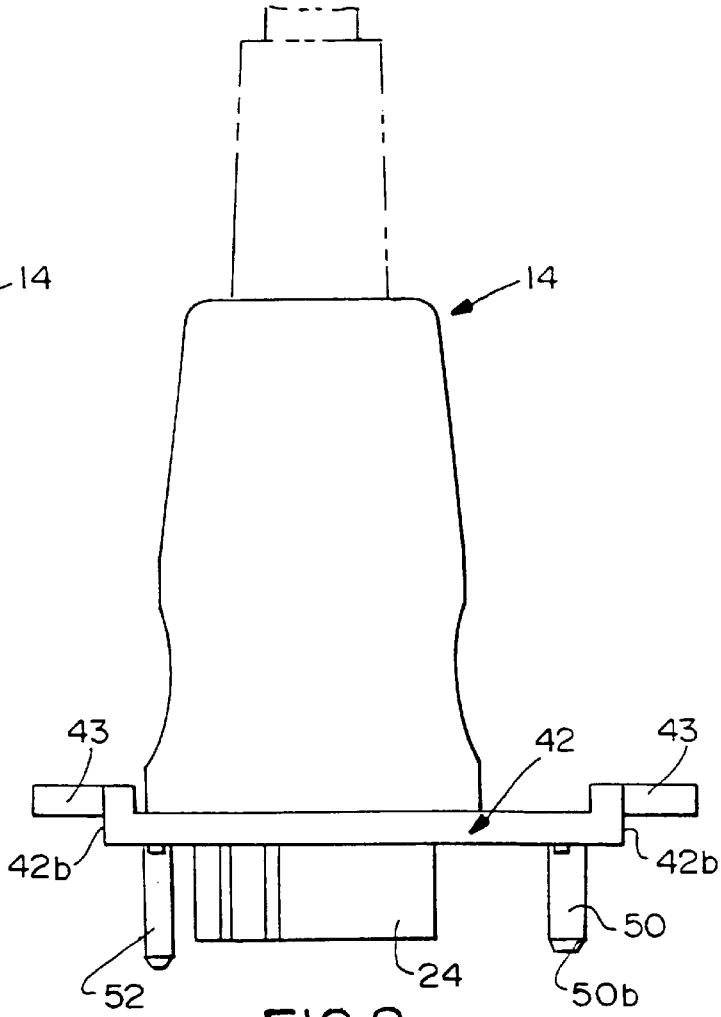
FIG. 8 is a top plan view of the plug connector.

Referring to FIGS. 7–9 in conjunction with FIG. 1, second or plug connector 14, which is part of the cradle assembly, is adapted for mating with first or receptacle connector 12. More particularly, plug connector 14 includes an elongated dielectric housing, generally designated 42, having plug portion 24 projecting forwardly thereof for insertion into receptacle 22 of receptacle connector 12. Elongated housing 42 has a pair of mounting ears 43 projecting from opposite edges of the housing. The ears have slots 43*a* for receiving appropriate fastening means to mount the connector in a supporting structure, such as in a cradle for receiving the handset of a mobile telephone system. A generally centrally located array of terminals 44 are mounted within a slot 46 in plug portion 24 for engaging terminals 26 (FIG. 1) on the outside of a tongue portion 48 within receptacle 22 of first connector 12.

The polarizing and blind mating means of the invention includes a generally hollow locating peg 50 projecting from plug connector 14. The locating peg 50 and the locating post 52 extend from the housing 42 a distance further than the plug portion 24 extends. This additional length will insure that the peg 50 and post 52 will be properly aligned with and engage pin 36 and locating slot 40 respectively before the terminals 44 in slot 46 will engage the terminals 26 on the outside of tongue portion 48. The locating peg is sized for insertion into DC jack socket 34 at front face 20 of receptacle connector housing 16 as best seen in FIG. 1. Locating peg 50 is slit, as at 50*a*, to form a generally C-shaped cross-sectional configuration for the peg so that the peg 50 avoids engagement with spring contact 38. The locating peg is generally hollow to accommodate central contact peg 36 of DC jack socket 34. The distal end of locating peg 50 preferably is chamfered, as at 50*b*, to facilitate insertion of the peg into the DC jack housing.

Whereas locating peg 50 is located nearer one edge 42*a* of elongated housing 42 of plug connector 14, a polygonal or rectangularly shaped locating post 52 projects from the housing nearer an opposite edge 42*b* of the housing. Therefore, locating peg 50 and locating post 52 are disposed at opposite edges of plug portion 24 of the connector and the generally centrally located array of signal contacts 44. Rectangular locating post 52 is sized for insertion into rectangular locating socket 40 of receptacle connector 12. Finally, rectangular locating post 52 preferably is of a size greater than DC jack socket 34 so that the locating post cannot be inserted into the DC jack socket.

From the foregoing, it can be understood that the invention utilizes a conventional DC jack socket 34, with its central contact pin 36, in conjunction with generally hollow locating peg 50 to provide at least part of the polarizing means for polarization of connectors 12 and 14 of connector assembly 10. Therefore, by using the already-provided DC jack socket, an independent polarizing means is not required which would require increasing the size of the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

a first connector including an elongated dielectric housing having a receptacle portion with a generally centrally located array of terminals, a conventional DC jack socket nearer one edge of the elongated housing outside one end of the array of terminals and adapted for receiving a conventional DC jack plug, with the DC jack socket including a central contact pin, and a polygonal locating socket nearer an opposite edge of the elongated housing outside an opposite end of the array of terminals, said DC jack socket and polygonal locating socket having a different cross sectional shape; and a second connector inserted in the first connector and including an elongated dielectric housing having a plug portion extending outwardly from a front face of the elongated housing, a generally centrally located array of terminals positioned in said plug portion for electrical connection to the terminals of the first connector, the second connector having a locating peg extending outwardly from said front face of the elongated housing nearer one edge of the elongated housing outside one end of the array of terminals and having an outer cross sectional shape adapted for insertion into the DC jack socket of the first connector, the locating peg being generally round and hollow to accommodate the central contact pin of the DC jack socket, and a polygonal locating post extending from said front face of the elongated housing nearer an opposite edge of the elongated housing outside an opposite end of the array of terminals and having an outer cross sectional shape adapted for insertion into the polygonal locating socket of the first connector, the locating peg and locating post extending from the housing a distance further than the plug portion extends.

2. The electrical connector assembly of claim 1 wherein said locating peg of the second connector is generally C-shaped in cross-section.

3. The electrical connector assembly of claim 1 wherein said polygonal locating socket and said polygonal locating post are generally rectangularly shaped in cross-section.

4. An electrical connector assembly, comprising:

a first connector including a dielectric housing having a receptacle portion with an array of terminals therein, a conventional DC jack socket on the housing spaced from the array of terminals and adapted for receiving a conventional DC jack plug, with the DC jack socket including a central contact pin, and a polygonal locating socket spaced from the DC jack socket and being of a different configuration therefrom; and a second connector for inserted in the first connector and including a dielectric housing having a plug portion extending outwardly from a front face of the housing, an array of terminals for electrical connection to the terminals of the first connector, the second connector having a locating peg extending outwardly from said front face of the housing and having an outer cross sectional shape adapted for insertion into the DC jack socket of the first connector, the locating peg being generally round and hollow to accommodate the central contact pin of the DC jack socket, and a locating post extending from said front face of the housing spaced from the locating peg and being of a configuration for insertion into the locating socket of the first connector, the locating peg and locating post extending from the housing a distance further than the plug portion extends.

5. The electrical connector assembly of claim 4 wherein said locating peg of the second connector is generally C-shaped in cross-section.

6. The electrical connector assembly of claim 4 wherein said polygonal locating socket and said polygonal locating post are generally rectangularly shaped in cross-section.

* * * * *